United States Patent [19]

Sassmannshausen et al.

[11] Patent Number: 4,903,570

[45] Date of Patent: Feb. 27, 1990

[54] SUPPORT DEVICE FOR PERCUSSION INSTRUMENTS

[75] Inventors: Werner Sassmannshausen; Werner Sassmanshausen, both of Bad Berleburg, Fed. Rep. of Germany

[73] Assignee: Johs. Link KG, Bad Berleburg, Fed. Rep. of Germany

[21] Appl. No.: 282,007

[22] Filed: Dec. 9, 1988

[30] Foreign Application Priority Data

Mar. 8, 1988 [DE] Fed. Rep. of Germany ..... 68803084[U]

[51] Int. Cl.[4] ..... G10D 13/02; G10G 5/00

[52] U.S. Cl. ..... 84/421; 84/413

[58] Field of Search ..... 84/411 R, 413, 415, 84/417, 421

[56] References Cited

U.S. PATENT DOCUMENTS

| | | | |
|---|---|---|---|
| 1,290,823 | 1/1919 | Wintrich | 84/411 R |
| 4,126,075 | 11/1978 | Kurosaki | 84/421 |
| 4,158,980 | 6/1979 | Gauger | 84/421 |
| 4,506,586 | 3/1985 | Brewer | 84/413 |

*Primary Examiner*—Lawrence R. Franklin

*Attorney, Agent, or Firm*—Toren, McGeady & Associates

[57] ABSTRACT

A support device and/or holding device for a musical percussion instrument, particularly for the instrument body of a membranophone which has a resonator. The support device includes a rigid holding member fastened to a support for the instrument. A flexible connecting member is arranged between the rigid support member and the rigid holding member. The connecting member is of a non-metal material with vibration damping and/or vibration absorbing properties. The holding member is exclusively mounted on the outer side of the instrument body and the support body is mounted on the inner side of the instrument body. The flexible connecting member is composed of a part arranged between the support member and the inner side of the instrument body and of a part arranged between the holding member and the outer side of the instrument body. One of the parts engages into openings in the instrument body. Tie rods or anchoring rods extend through the opening between the holding member and the support member.

6 Claims, 1 Drawing Sheet

FIG. 1
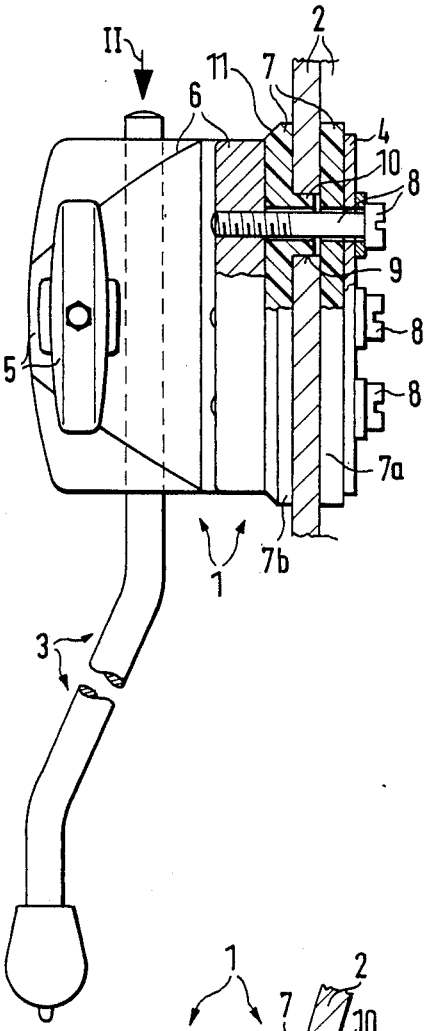
FIG. 3
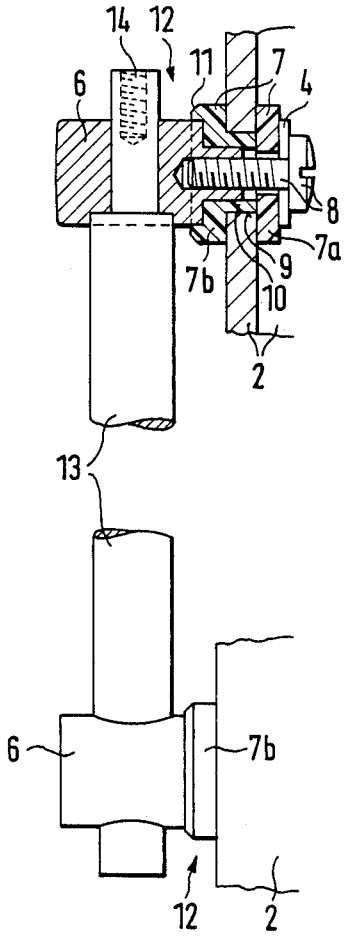
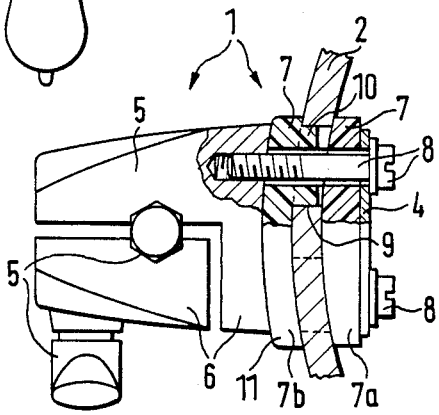
FIG. 2

SUPPORT DEVICE FOR PERCUSSION INSTRUMENTS

BACKGROUND OF THE INVENTION

1. Field of the Invention

The present invention relates to a support device and/or holding device for musical percussion instruments, particularly for the instrument body of membranophones which acts as a resonator. The support device includes a rigid support member fastened to the instrument body and a rigid holding member which is fastened or can be fastened to a support, for example, a leg, an arm, a stand and/or a frame. A flexible connecting member is arranged between the rigid support member and the rigid holding member. The connecting member is of a non-metal material with vibration damping and/or vibration absorbing properties.

2. Description of the Related Art

A support device of the above-described type is known from German Offenlegungsschrift 33 39 397. This known support device is constructed in such a way that it not only improves the vibrating capability of the instrument body of membranophones acting as a resonator, but it also effectively prevents a transmission of vibrations between musical instruments which are connected to each other and between musical instruments and the ground on which the musical instruments are placed. This provides the advantage that, on the one hand, an improvement of the sound of the individual musical percussion instruments can be achieved while, on the other hand, it is effectively prevented that musical percussion instruments which are mounted as a group can influence each other.

In the known support device, the flexible connecting member of non-metal material with vibration damping and/or vibration absorbing properties is connected to the support member as well as to the holding member, so that these components together form a structural vibration metal unit.

Although the support devices constructed as structural vibration metal units have been found useful in practice, they cannot be used for all possible purposes for which musical percussion instruments are intended, because the entire structural vibration metal unit projects from the outer circumference of the instrument body and, thus, requires a certain amount of space which is not always available. It should be kept in mind that usually several different musical percussion instruments are combined to form a set of instruments, i.e., a so-called drum set. It must be ensured that the individual percussion instruments of the drum set can be adjusted in variable position, so that the drum set can be adapted to the individual requirements of the musicians using the drum set. Accordingly, percussion instruments to be arranged in a group must be mounted with their instrument bodies relatively closely together and, therefore, it is desirable that the support devices project as little as possible beyond the outer surface of the instrument bodies.

It is, therefore, the primary object of the present invention to provide a support device of the above-described type which projects only insignificantly beyond the outer circumference of the instrument body of the musical instruments, while still ensuring an optimum vibration capability of the instrument body acting as resonator and effectively preventing the transmission of vibrations between musical instruments which are connected to each other and between musical instruments and the ground on which they are placed.

SUMMARY OF THE INVENTION

In accordance with the present invention, the holding member is exclusively mounted on the outer side of the instrument body, while the support member is mounted on the inner side of the instrument body. The flexible connecting member is composed of a part arranged between the support member and the inner side of the instrument body and of a part arranged between the holding member and the outer side of the instrument body. One of the parts engages into openings in the instrument body, tie rods or anchoring rods extending through the openings between the holding member and the support member.

Since the two parts forming the flexible connecting member are structurally separate from the support member and from the holding member, the parts can be easily replaced and, thus, can be adapted in an optimum manner to different requirements not only with respect to their dimensions but also with respect to their hardness.

In accordance with another feature of the present invention, the part of the flexible connecting member arranged with the holding member is a plate with shoulders or necks formed on the rear side thereof for engagement in the opening of the instrument body. The part of the flexible connecting member arranged with the support member is a simple plate.

The flexible connecting member constructed in accordance with the above feature increases the useful value of the support device because an optimum adaptation of the connecting member to different requirements is facilitated.

Finally, the present invention further provides that the plate of the flexible connecting member placed underneath the holding member has a surface area of such a size that the plate projects on all sides beyond the contacting surface of the holding member.

The various features of novelty which characterize the invention are pointed out with particularity in the claims annexed to and forming a part of this disclosure. For a better understanding of the invention, its operating advantages attained by its use, reference should be had to the drawings and descriptive matter in which there are illustrated and described preferred embodiments of the invention.

BRIEF DESCRIPTION OF THE DRAWING

In the drawing:

FIG. 1 is a side view, partially in section, of a support device according to the present invention mounted on a shell of a drum, the support device being connected to a support leg;

FIG. 2 a view, partially in section, of the support device of FIG. 1, seen in direction of arrow II of FIG. 1; and FIG. 3 is a side view, partially in section, of another embodiment of a support device according to the present invention.

DESCRIPTION OF THE PREFERRED EMBODIMENTS

As illustrated in FIGS. 1 and 2, a support device 1 is arranged, for example, on the outer circumference of an instrument body 2 of a musical percussion instrument, for example, on the shell of a drum. The support device 1 serves for the adjustable fastening of a support 3 in the form of a leg, only partially illustrated in FIG. 1.

The support device 1 is formed by a rigid support member formed in the form of a plate mounted on the instrument body 2, i.e., on the shell of the drum, and a rigid holding member 6 which can be fastened to a support 3, for example, a leg, by means of a clamping device 5, as well as a flexible connecting member 7 arranged between the rigid holding member 6 and the rigid support member 4.

While the plate forming the support member 4 is placed against the inner side of the instrument body 2, the holding member 6 is placed on the outer side of the instrument body 2. The connection between the support member 4 and the holding member 6 is effected by tie rods 8 in the form of screws which extend through an opening 9 each in the instrument body 2, as can be clearly seen in FIGS. 1 and 2.

The flexible connecting member 7 is formed by two parts *7a* and *7b* which are each essentially constructed plate-shaped and preferably are of rubber or a soft elastic plastics material. The part *7a* of the flexible connecting member 7 is arranged between the inner side of the instrument body 2 and the support member 4 which has the shape of a plate. The part *7b* of the flexible connecting member 7, on the other hand, is placed on the outer side of the instrument body 2 and serves as an abutment for the holding member 6.

At each location where a screw acting as a tie rod between the support member 4 and the holding member 6 is arranged, the part *7a* as well as the part *7b* of the flexible connecting member 7 has a passage opening through which the tie rods 8 are inserted.

In accordance with an important feature of the flexible connecting element 7, at least one of the parts *7a*, *7b*, for example, part *7b*, engages also into the opening 9 of the instrument body 2. For this purpose, the part *7b* of the flexible connecting element 7 provided at the holding member 6 is constructed as a plate on the back side of which collars are provided which can engage into the openings 9 of the instrument body 2.

At the surfaces of the two parts *7a* and *7b* of the flexible connecting member 7 facing the instrument body 2 are adapted to the contour of the instrument body 2, i.e., to the curvature of the instrument. The surfaces of these parts *7a* and *7b* facing away from the instrument body 2 may have a shape which deviates from the contour of the instrument body 2, for example, the surfaces may be plane, as it is shown in FIG. 2 in the case of part *7a* in the region of the contact surface thereof with the support member 4 having the shape of a plate.

The tie rods 8 generate an initial tension between the support member 4 and the holding member 6 which is adjusted in such a way that the effect of the connecting member 7 of non-metal material with vibration damping and/or vibration observing properties, particularly rubber, plastics material or the like, is entirely unimpaired while the seat of the holding member 6 on the instrument body 2 is not negatively influenced.

It has been found particularly useful if the part *7b* of the connecting member 7, which is constructed as a plate and is placed underneath the holding member 6 on the outer side of the instrument body 2, has a surface area of such a size that the plate projects at all sides beyond the contacting surface of the holding member 6, as can be clearly seen in FIGS. 1 and 2. To improve the appearance of the support member 1, the outer rim of the plate forming the part *7b* can be provided with a bevel 11 which extends up to the outer circumference of the support member 6.

The thicknesses of the layers forming the parts *7a* and *7b* of the connecting member 7 as well as the wall thickness of the shoulders 10 formed on the back side of the part *7b* are selected in such a way that an optimum damping and absorption behavior between the instrument body 2 and the support device 1 connected to the instrument body 2 is obtained and permanently maintained.

Since the two parts *7a* and *7b* of the flexible connecting member 7 are releasably connected to the support member 4 and the holding member 6 as well as to the instrument body 2, it is possible to use parts *7a* and *7b* having a different material density and/or material hardness, so that the damping and/or absorption behavior between the instrument body 2 and the support member 1 can be varied as required.

The support device 12 according to the present invention shown in FIG. 3 is in its basic construction, i.e., with respect to the interaction of support member 4, holding member 6 and flexible connecting member 7, practically the same as the support device 1 shown in FIGS. 1 and 2. The flexible connecting member 7 is also in this case composed of two parts *7a* and *7b*, the first of which is placed on the inner side and the second is placed on the outer side of the instrument body 2.

In the embodiment shown in FIG. 3, the part *7b* of the flexible connecting member 7 is also provided on the back side thereof with a collar 10 which engages in an opening 9 of instrument body 2.

However, as shown in FIG. 3 of the drawing, two structurally identical support devices 12 are arranged axially aligned in a direction extending parallel to the longitudinal axis of the instrument body 2, i.e., of the shell of the instrument. The two support devices 12 receive a longitudinal rod 13 to which a cantilever member of a special stand and/or frame can be coupled.

The support device 12 according to FIG. 3 can be used particularly in connection with skin tensioning devices as they are provided, for example, on the shell of percussion drums. In such a case, a plurality of longitudinal rods 13 are mounted by two support devices 12 each uniformly around the circumference of the shell. The end portions of the longitudinal rods 13 projecting out of the holding member 6 have threaded bores 14 for engagement with the adjusting members of the skin tensioning devices.

While specific embodiments of the invention have been shown and described in detail to illustrate the application of the inventive principles, it will be understood that the invention may be embodied otherwise without departing from such principles.

We claim

1. A support device for a musical percussion instrument, such as a membranophone, the support device being attached to an instrument body of the instrument which acts as a resonator, the support device including a rigid support member fastened to the instrument body and a rigid holding member fastened to a support means for the instrument, a flexible connecting member being arranged between the rigid support member and the rigid holding member, the connecting member being of a non-metal materia with vibration damping and/or vibration absorbing properties, the instrument body having an inner side and an outer side, the instrument body defining openings, tie rods connected between the holding member and the support member extending through the opening, the holding member being exclusively mounted on the outer side of the instrument body, the support member being mounted on the inner side of the instrument body, the flexible connecting member being composed of a first part arranged between the support member and the inner side of the instrument body and of a second part arranged between the holding member and the outer side of the instrument body, one of the first and second parts having a portion engaging into one of the openings in the instrument body.

2. The support device according to claim 1, wherein the second part has the portion extending into the opening.

3. The support device according to claim 2, wherein the first part and the second part are plate-shaped, the second part having a rear side, the portion engaging into the opening of the instrument body being formed on the rear side of the second part.

4. The support device according to claim 3, wherein the plate-shaped second part of the flexible connecting element has a surface facing the holding member, a beveled edge being formed on the surface facing the holding member.

5. The support device according to claim 2, wherein the second part has a surface area of such a size that the second part projects on all sides beyond the surface of the holding member which contacts the second part.

6. The support device according to claim 1, the instrument body having a longitudinal axis, two holding members being arranged spaced apart and in alignment parallel to the longitudinal axis of the instrument body, a longitudinal rod being connected between and aligned by the two holding members.

* * * * *

UNITED STATES PATENT AND TRADEMARK OFFICE

CERTIFICATE OF CORRECTION

PATENT NO. : 4,903,570

DATED : February 27, 1990

INVENTOR(S) : Werner Sassmannshausen et al

It is certified that error appears in the above-identified patent and that said Letters Patent is hereby corrected as shown below:

In the heading of the Patent, it should read:

[30] Foreign Application Priority Data

March 8, 1988 Fed. Rep. of Germany ... 8803084

Signed and Sealed this

Thirtieth Day of July, 1991

*Attest:*

HARRY F. MANBECK, JR.

*Attesting Officer*

*Commissioner of Patents and Trademarks*